US010431912B2

(12) United States Patent
Murtagian et al.

(10) Patent No.: US 10,431,912 B2
(45) Date of Patent: Oct. 1, 2019

(54) CPU SOCKET CONTACT FOR IMPROVING BANDWIDTH THROUGHPUT

(71) Applicant: Intel Corporation, Santa Clara, CA (US)

(72) Inventors: Gregorio R. Murtagian, Phoenix, AZ (US); Zhichao Zhang, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/721,358

(22) Filed: Sep. 29, 2017

(65) Prior Publication Data

US 2019/0103687 A1 Apr. 4, 2019

(51) Int. Cl.

| | |
|---|---|
| ***H01R 12/00*** | (2006.01) |
| ***H01R 12/70*** | (2011.01) |
| ***H01R 13/24*** | (2006.01) |
| ***H01R 13/646*** | (2011.01) |
| ***H01R 13/6474*** | (2011.01) |
| *H01R 43/16* | (2006.01) |

(52) U.S. Cl.

CPC ..... *H01R 12/7076* (2013.01); *H01R 13/2442* (2013.01); *H01R 13/2485* (2013.01); *H01R 13/646* (2013.01); *H01R 13/6474* (2013.01); *H01R 43/16* (2013.01)

(58) Field of Classification Search

CPC .... H01R 23/722; H01R 23/725; H01R 12/57; H01R 13/2442; H05K 7/1069

USPC ..... 439/66, 71, 74, 78, 83, 862

See application file for complete search history.

(56) References Cited

U.S. PATENT DOCUMENTS

| | | | | | |
|---|---|---|---|---|---|
| 4,813,881 | A * | 3/1989 | Kirby | H01R 13/111 | 439/381 |
| 5,997,315 | A * | 12/1999 | Akama | H01R 13/2442 | 439/326 |
| 6,183,266 | B1 * | 2/2001 | Turner | H01R 24/50 | 439/101 |
| 6,530,788 | B1 * | 3/2003 | Ju | H01R 12/57 | 439/83 |
| 6,929,483 | B2 * | 8/2005 | Huang | H01R 13/2442 | 439/66 |
| 7,052,289 | B1 * | 5/2006 | Hao | H01R 12/57 | 439/83 |
| 7,114,959 | B2 * | 10/2006 | Stone | H01R 13/2442 | 439/66 |
| 7,150,632 | B2 * | 12/2006 | Lee | H01R 13/2435 | 439/66 |
| 7,297,007 | B2 * | 11/2007 | Hao | H01R 12/57 | 439/83 |

(Continued)

*Primary Examiner* — Thanh Tam T Le

(74) *Attorney, Agent, or Firm* — Grossman, Tucker, Perreault & Pfleger, PLLC

(57) ABSTRACT

High-speed data transmissions through a CPU socket are facilitated with CPU socket contacts that have a CPU socket contact body that improves bandwidth throughput. The CPU socket contact body is partially suspended from a CPU socket contact and may include a cavity. The CPU socket contact body includes capacitive impedance that substantially cancels an inductive impedance of the CPU socket contact. Canceling the inductive impedance causes the CPU socket contact to operate like an impedance-matched coaxial transmission line, which enables better bandwidth throughput than a non-impedance matched transmission line.

25 Claims, 5 Drawing Sheets

(56) References Cited

U.S. PATENT DOCUMENTS

| | | | | |
|---|---|---|---|---|
| 7,303,421 | B2 * | 12/2007 | Liao | H01R 4/02 439/342 |
| 7,429,200 | B2 * | 9/2008 | Lee | H01R 13/2442 439/862 |
| 7,806,700 | B2 * | 10/2010 | DeSantis | H01R 12/57 439/66 |
| 7,828,558 | B2 * | 11/2010 | Ma | H01R 12/716 439/66 |
| 7,857,632 | B2 * | 12/2010 | Liu | H01R 13/2492 439/66 |
| 7,938,647 | B2 * | 5/2011 | Zheng | H01R 12/714 439/66 |
| 7,976,319 | B2 * | 7/2011 | Nguyen | H01R 4/028 439/83 |
| 7,989,045 | B2 * | 8/2011 | Chang | H01R 12/57 174/366 |
| 8,172,591 | B2 * | 5/2012 | Wertz | H01R 12/718 439/246 |
| 8,235,093 | B2 * | 8/2012 | Grinbergs | F24F 3/1411 165/165 |
| 8,298,021 | B2 * | 10/2012 | Huang | H01R 13/2492 439/500 |
| 8,366,453 | B2 * | 2/2013 | Chang | H01R 12/58 439/66 |
| 8,535,093 | B1 * | 9/2013 | Mason | H01R 13/6585 439/607.05 |
| 8,758,068 | B2 * | 6/2014 | Wang | H01R 4/02 439/816 |
| 8,888,525 | B2 * | 11/2014 | Yeh | H01R 13/17 439/539 |
| 9,887,480 | B2 * | 2/2018 | Tanaka | H01R 13/2442 |

* cited by examiner

CPU SOCKET CONTACT FOR IMPROVING BANDWIDTH THROUGHPUT

TECHNICAL FIELD

The present disclosure relates to systems and methods for improving bandwidth through electrical component connections.

BACKGROUND

Next generation motherboard architectures will support faster speeds than some motherboard components are currently able to support. For example, the $5^{th}$ generation of PCI-express architecture will support differential signal speeds of up to 32 giga-transfers per second, yielding 128 gigabytes per second in full duplex networking configurations. Despite the bandwidth potential of some of the motherboard components and next generation central processing units ("CPUs"), the socket between the CPU and the motherboard is a bottleneck in current CPU socket designs. In particular, current CPU socket contacts are a bandwidth bottleneck between the motherboard and the CPU because the CPU socket contacts have impedance characteristics that are not well-designed for higher frequency operation.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
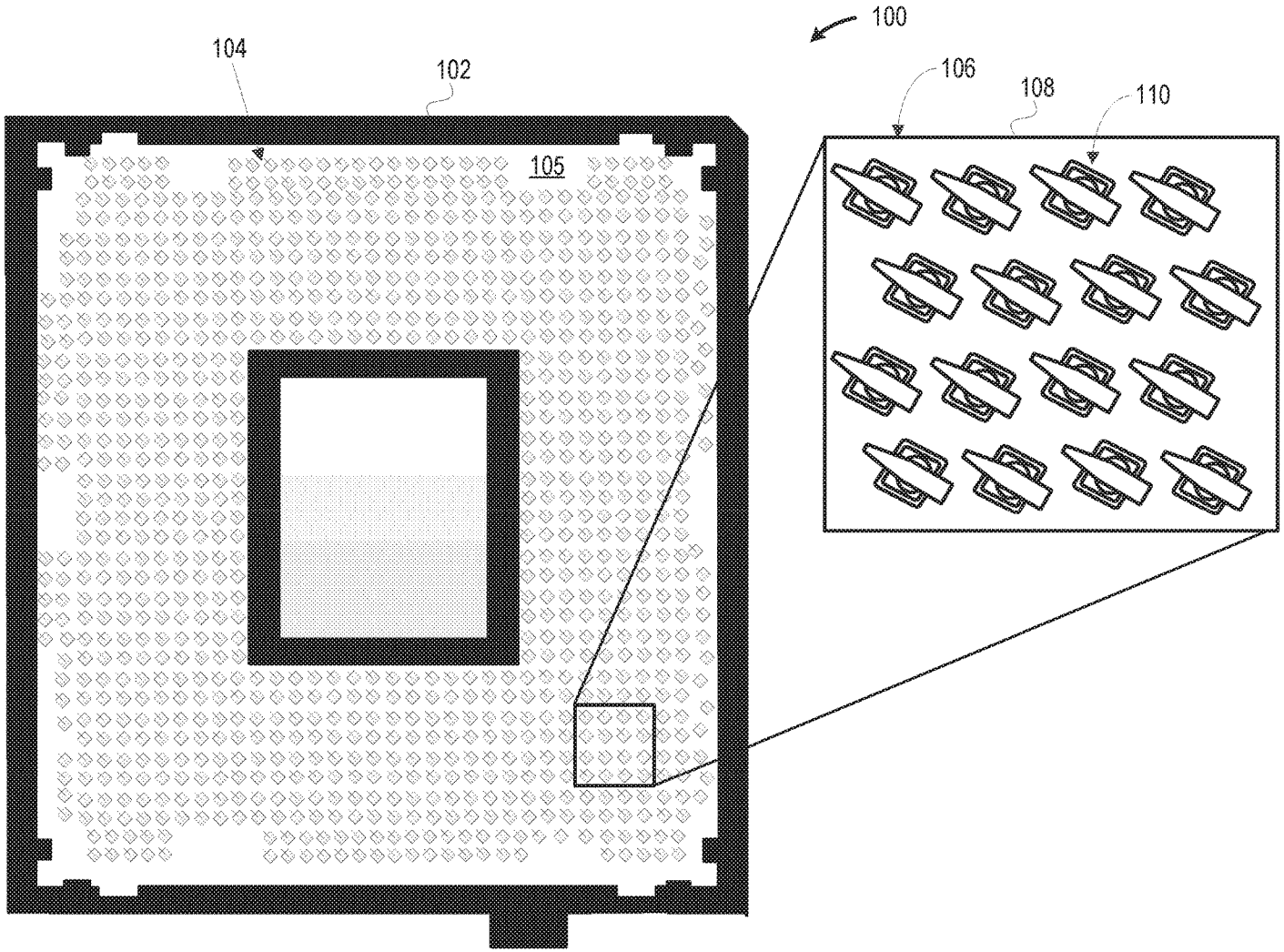
FIG. 1 is a schematic depicting an illustrative CPU socket which includes CPU socket contacts for improving bandwidth throughput, in accordance with at least one embodiment described herein.

Although the following Detailed Description will proceed with reference being made to illustrative embodiments, many alternatives, modifications and variations thereof will be apparent to those skilled in the art.

DETAILED DESCRIPTION

High-speed data transmissions through a central processing unit ("CPU") socket are facilitated with CPU socket contacts that have a CPU socket contact body that improves bandwidth throughput, in accordance with at least one embodiment described herein. The CPU socket contact body is partially suspended from a CPU socket contact and includes a cavity. The CPU socket contact body may induce capacitive impedance that substantially cancels an inductive impedance of the CPU socket contact body. Canceling the inductive impedance may cause the CPU socket contact to operate like an impedance matched coaxial transmission line, which enables better bandwidth throughput than a non-impedance matched transmission line. Advantageously, by canceling the inductive impedance of the CPU socket contact with capacitive impedance, the CPU socket contact may exhibit less standing wave reflection losses and may therefore provide improved high-speed data throughput.

The CPU socket contacts may be stamped metal contacts. The stamped metal contacts may include a CPU socket contact body that has metal features to create capacitive interactions with surrounding CPU socket contact bodies that are, for example, ground pins. This capacitive interaction with surrounding CPU socket contact bodies may reduce the impedance mismatch and losses associated with the contact design and may push the resonance frequency of the CPU socket contact to higher bands, which may support a broader spectrum of frequencies and higher data rate. Advantageously, the disclosed CPU socket contact may be manufactured using existent manufacturing infrastructure and distribution channels.

A CPU socket contact is provided. The CPU socket contact may include a solder ball base configured to couple the CPU socket contact to a motherboard; a contact tip configured to receive contact from a landing pad of a CPU; a spring arm coupled to the contact tip to suspend the contact tip at one or more distances from the solder ball base; a spine coupled between the solder ball base and the spring arm; and a CPU socket contact body coupled to the spine and suspended between the spring arm and the solder ball base. The solder ball base, contact tip, spring arm, spine, and CPU socket contact body may be formed from a single piece of metal.

A CPU socket is provided. The CPU socket may include a socket body. The socket body may include a first side configured to be mated proximate to a motherboard; and a second side configured to carry a CPU. The CPU socket may include a CPU socket contact that is one of a plurality of CPU socket contacts coupled to the socket body and extending between the first side and the second side to electrically coupled the CPU to the motherboard. The CPU socket contact may include a solder ball base configured to couple the CPU socket contact to the motherboard; a contact tip configured to receive contact from a landing pad of a CPU; a spring arm coupled to the contact tip to suspend the contact tip at one or more distances from the solder ball base; a spine coupled between the solder ball base and the spring arm; and a CPU socket contact body coupled to the spine and suspended between the spring arm and the solder ball base. The solder ball base, contact tip, spring arm, spine, and CPU socket contact body may be formed from a single piece of metal.

A CPU socket is provided. The CPU socket may include a socket body. The socket body may include a first side configured to be mated proximate to a motherboard; and a second side configured to carry a CPU. The CPU socket may include a CPU socket contact that is one of a plurality of CPU socket contacts coupled to the socket body and extending between the first side and the second side to electrically coupled the CPU to the motherboard. The CPU socket contact may include a solder ball base configured to couple the CPU socket contact to the motherboard; a contact tip configured to receive contact from a landing pad of a CPU; a spring arm coupled to the contact tip to suspend the contact tip at one or more distances from the solder ball base; a spine coupled between the solder ball base and the spring arm; and a CPU socket contact body means for providing capacitive impedance to substantially cancel an inductive impedance of the CPU socket contact.

A method of manufacturing a CPU socket contact. The method may include forming a solder ball base configured to couple the CPU socket contact to a CPU socket; forming a contact tip configured to receive contact from a landing pad of a CPU; forming a spring arm coupled to the contact tip to suspend the contact tip at one or more distances from the solder ball base; forming a spine coupled between the solder ball base and the spring arm; and forming a CPU socket contact body coupled to the spine and suspended between the spring arm and the solder ball base. The solder ball base, contact tip, spring arm, spine, and CPU socket contact body may be formed from a single piece of metal.

As used herein, the term motherboard refers to a computing device (e.g., personal computer, server, tablet, smart phone, graphics card, etc.) motherboard that is an interface between a CPU and one or more electronic components or interface cards.

FIG. 1 depicts an illustrative central processing unit ("CPU") socket 100 that includes CPU socket contacts for improving bandwidth throughput by improving signal integrity between a CPU and a motherboard, between which the CPU socket 100 is coupled, in accordance with at least one embodiment described herein. The CPU socket 100 includes a socket body 102 and a contact array 104 for improving bandwidth throughput between a CPU and a motherboard, in accordance with at least one embodiment described herein.

The socket body 102 carries the contact array 104 and provides a mechanical interface for receiving and carrying a CPU. The socket body 102 may be formed from one or more of a polymer, thermoplastic, or other composite. The socket body 102 may provide an interface between a CPU and a motherboard, between which the CPU socket 100 is electrically and physically coupled, in accordance with at least one embodiment described herein. The socket body 102 receives and carries a CPU and physically and electrically couples the CPU to the motherboard through the contact array 104, in accordance with at least one embodiment described herein. The CPU socket 100 couples the CPU with the contact array 104 so that each of the contacts in the contact array 104 make contact with corresponding conductive landing pads that are disposed on a surface of the CPU, in accordance with at least one embodiment described herein.

The socket body 102 includes a first side 105 and a second side (not shown), in accordance with at least one embodiment described herein. The first side 105 is a top side or a CPU side that faces away from the motherboard and the faces the CPU, in accordance with at least one embodiment described herein. The second side is a bottom side or a motherboard side that faces towards the motherboard and away from the CPU, in accordance with at least one embodiment described herein.

The contact array 104 may be physically coupled to the socket body 102. Each of the contacts of the contact array 104 are pressed into the socket body 102 to physically couple each contact of the contact array 104 to the socket body 102, in accordance with at least one embodiment described herein. Each of the contacts of the contact array 104 are frictionally coupled to the socket body 102 to maintain a position of the contacts within the socket body 102, in accordance with at least one embodiment described herein. The contact array 104, once physically coupled to the socket body 102, enables a user to selectively secure a CPU to the CPU socket 100, to electrically communicate with a motherboard, in accordance with at least one embodiment described herein. The contact array 104 may have 2011 contacts with a hexagonal pitch (e.g., 39 mm) between the contacts to provide increased density of contacts over square pitch contact arrays or contact arrays having other design characteristics, in accordance with at least one embodiment described herein.

The inset 106 illustrates a subset 108 of the contact array 104, in accordance with at least one embodiment described herein. The subset 108 of the contact array 104 illustrates each CPU socket contact 110 that make up the contact array 104, in accordance with at least one embodiment described herein. The inset 106 illustrates a top view of the subset 108 of the contact array 104 and provides a top view of the CPU socket contact 110, in accordance with at least one embodiment described herein.

Figure 2B:
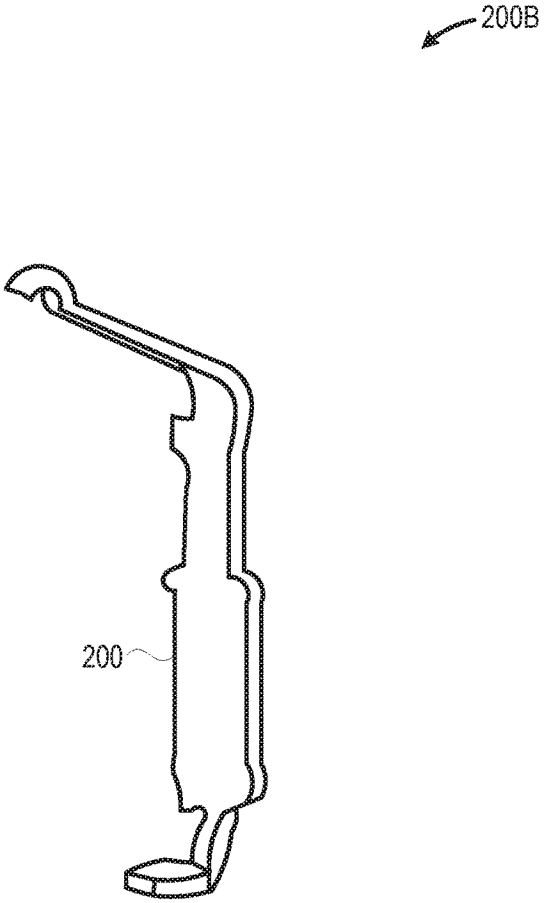
FIGS. 2A, 2B, 2C, and 2D are schematics depicting some illustrative CPU socket contacts that are bandwidth limited and some illustrative CPU socket contacts that improve bandwidth throughput in a CPU socket, in accordance with at least one embodiment described herein.
Figure 2A:
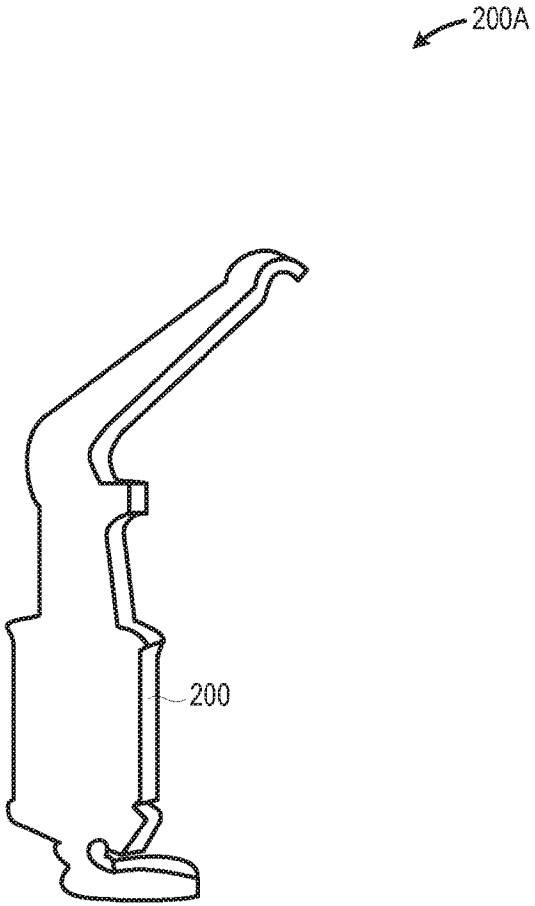
Figure 2D:
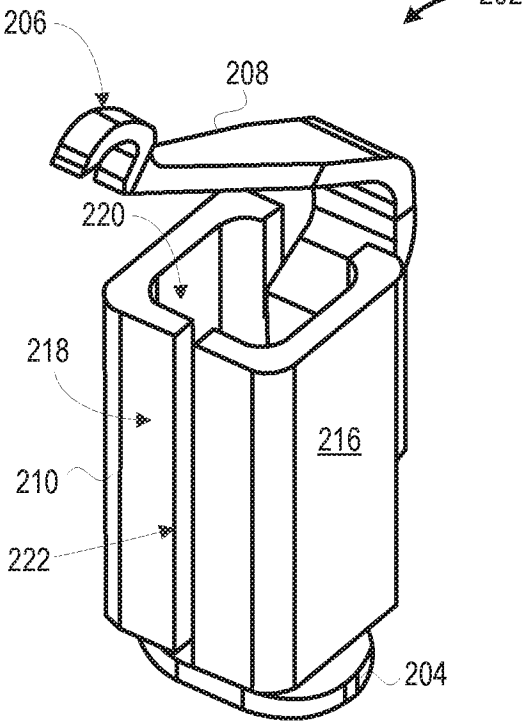
Figure 2C:
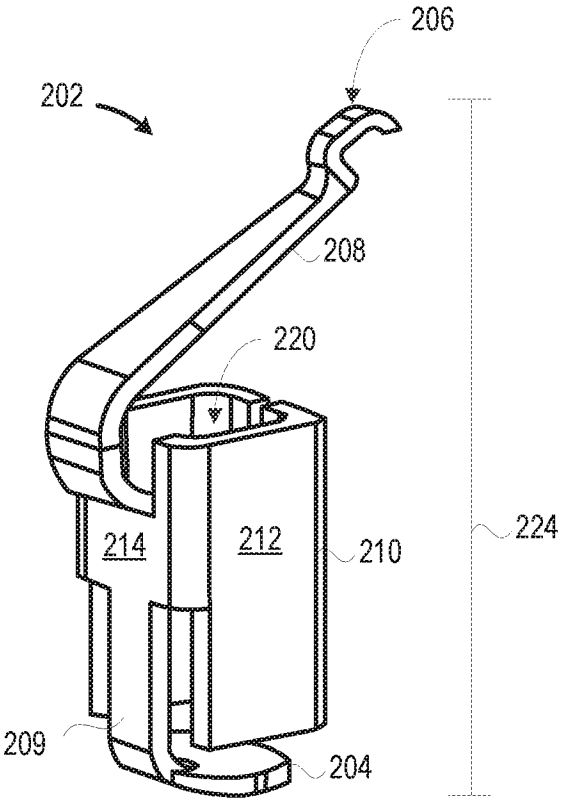

FIGS. 2A, 2B, 2C, and 2D depict illustrative views of a traditional CPU socket contact 200 that is bandwidth limited by impedance mismatches and depict illustrative views of a CPU socket contact 202 that is impedance matched to improve the bandwidth throughput of the CPU socket 100 (shown in FIG. 1), in accordance with at least one embodiment described herein. FIG. 2A depicts an illustration of a rear perspective view of the traditional CPU socket contact 200, and FIG. 2B illustrates a front perspective view of the traditional CPU socket contact 200. By contrast, FIG. 2C illustrates a rear perspective view of the CPU socket contact 202, and FIG. 2D illustrates a front perspective view of the CPU socket contact 202, in accordance with at least one embodiment described herein. As discussed above, the traditional CPU socket contact 200 sufferers from signal reflection and losses at the frequencies likely to be used in next generation motherboard architecture (e.g., 32 giga-transfers per second for generation 5 PCI-E). The signal reflection and losses are functionally a bottleneck for information transmission speeds between a CPU and a motherboard, between which the CPU socket 100 is coupled. Advantageously, the CPU socket contact 202 includes a metal contact body that is integrated into the CPU socket contact 202 and that causes the CPU socket contact 202 to function as an impedance-matched (or nearly matched) transmission line at the frequencies of operation for a CPU (e.g., 128 gigabytes per second in full duplex networking configurations), in accordance with at least one embodiment described herein. In particular, the metal contact body of the CPU socket contact 202 may enable the CPU socket contact 202 to operate or function with the inductive and capacitive characteristics of a coaxial transmission line, in accordance with at least one of embodiment described herein. The inductive and capacitive coaxial transmission line characteristics enable the CPU socket contact 202 to pass data or information from the CPU, through the CPU socket 100, to a motherboard at higher frequencies, with less signal reflection or other losses (e.g., standing wave reflection losses), in accordance with at least one embodiment described herein.

Referring to FIG. 2C and FIG. 2D, the CPU socket contact 202 functions as an electrical connection between the CPU and motherboard as a transmission line, in accordance with at least one embodiment described herein. The CPU socket contact 202 includes a solder ball base 204, a contact tip 206, a spring arm 208, a spine 209, and a CPU socket contact body 210 for electrically coupling a CPU to a motherboard, while functioning as a transmission line, in accordance with at least one embodiment described herein. The solder ball base 204 provides a foundation to which a solder ball may physically and electrically couple the CPU socket contact 202 to the motherboard, in accordance with at least one embodiment described herein. In one implementation, the solder ball base 204 is replaced with a second spring arm (not shown) that physically and electrically couple to a landing pad on a motherboard, making the CPU socket 100 a dual compression socket. The contact tip 206 provides a non-abrasive surface that physically and electrically couples to a landing pad of a CPU to receive and transmit information between the CPU and a motherboard, in accordance with at least one embodiment described herein. The spring arm 208 positions the contact tip 206 a designed distance above the solder ball base 204, while concurrently providing a flexible, and compressible structure that provides a compression force on the CPU while the CPU is secured onto the socket body 102, in accordance with at least one embodiment described herein. In one embodiment, the spring arm 208 positions the contact tip 206 a distance 224 that is approximately 3 mm from the solder ball base 204. In one embodiment, the spring arm 208 positions the contact tip 206 a distance 224 that is between 2 mm and 4 mm from the solder ball base 204. In one embodiment, when the spring arm 208 is compressed, the spring arm 208 positions the contact tip 206 a distance 224 that is between 1.7 mm and 3.4 mm from the solder ball base 204.

The CPU socket contact body 210 is formed from a single piece of metal (e.g., is stamped from a single sheet of metal) along with the solder ball base 204, the contact tip 206, spring arm 208, and the spine 209, in accordance with at least one embodiment described herein. The CPU socket contact body 210 is a means for providing or inducing capacitive impedance to substantially cancel an inductive impedance of the CPU socket contact 202, according to one embodiment. The CPU socket contact body 210 provides one or more surfaces that capacitively interact with other adjacent or proximally positioned contacts (e.g., grounded contacts), in accordance with at least one embodiment described herein. The capacitance impedance of the CPU socket contact body 210 combines with inductive impedance of the entire CPU socket contact 202 to cancel or negate the imaginary (verses real) impedance of the CPU socket contact 202, which impedance-matches the CPU socket contact 202, in accordance with at least one embodiment described herein. The capacitance impedance of the CPU socket contact body 210 combines with inductive impedance of the solder ball base 204, the landing pad contact 206, the spring arm 208, and the spine 209 to cancel or negate the imaginary impedance of the CPU socket contact 202, which impedance-matches the CPU socket contact 202, in accordance with at least one embodiment described herein. Through this impedance matching, the resonance frequency of the CPU socket contact 202 is increased by the CPU socket contact body 210, which reduces signal reflection and signal losses that occur along metal structures that have not been matched or otherwise designed for manufactured to operate at particular ranges of frequencies, in accordance with at least one embodiment described herein.

The CPU socket contact body 210 includes an outer surface and a cavity. The CPU socket contact body 210 is a rectangular cuboid, in accordance with at least one embodiment described herein. The CPU socket contact body 210 is cylindrical or is polyhedron-shaped, in accordance with at least one embodiment described herein. The CPU socket contact body 210 may include one or more of a first contact body surface 212, a second contact body surface 214, a third contact body surface 216, a fourth contact body surface 218, and a cavity 220, in accordance with the police one embodiment described herein. In one embodiment, the CPU socket contact body 210 omits the fourth contact body surface 218 and includes the first contact body surface 212, the second contact body surface 214, and the third contact body surface 216. In one embodiment, the CPU socket contact body 210 is triangular prism-shaped. The height of one or more of the first contact body surface 212, the third contact body surface 216, and the fourth contact body surface 218 are approximately half of the distance from the bottom of the solder ball base 204 to the contact tip 206, in accordance with at least one embodiment described herein. The width of one or more of the first contact body surface 212, the third contact body surface 216, and the fourth contact body surface 218 is approximately the length of the longest dimension of the solder ball base 204, in accordance with at least one embodiment described herein.

The cavity 220 is an aperture that extends the longest dimension (e.g., the length) of the first contact body surface 212, the third contact body surface 216, and the fourth contact body surface 218, in accordance with at least one embodiment described herein. The fourth contact body surface 218 includes a slit or opening 222 that is an artifact of the CPU socket contact 202 being manufactured from a single piece of metal, in accordance with at least one embodiment described herein. The opening 222 of the fourth contact body surface 218 may be closed or formed such that the surface area of the fourth contact body surface 218 is similar to the surface area of the third contact body surface 216 and the first contact body surface 212, so that the capacitive characteristics of the first contact body surface 212, the third contact body surface 216, and the fourth contact body surface 218 are similar to one another, in accordance with at least one embodiment described herein. The opening 222 may extend from the first contact body surface 212 to the third contact body surface 216, so that no fourth contact body surface 218 exists, in accordance with at least one embodiment described herein.

Figure 3:
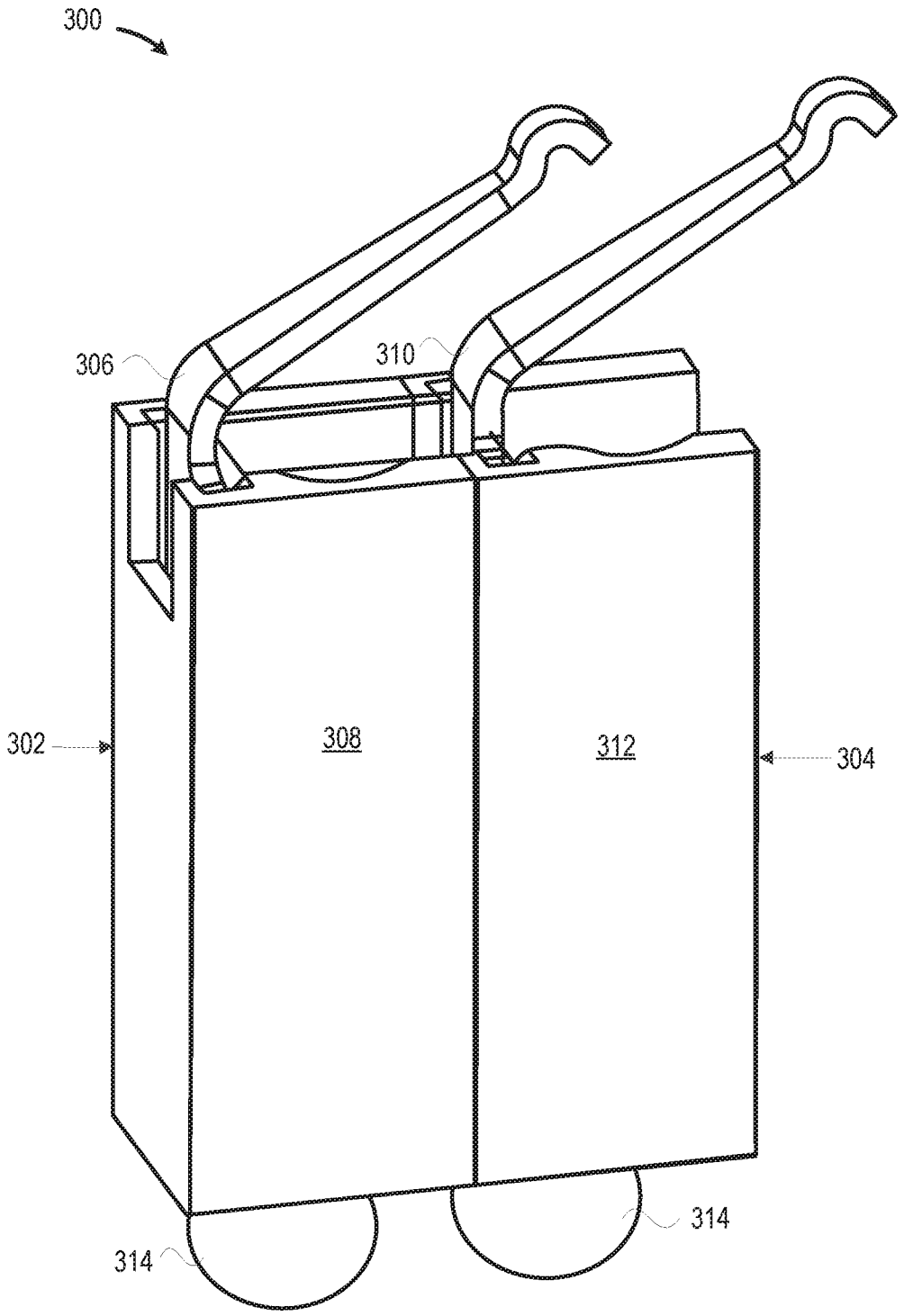
FIG. 3 is a schematic depicting an illustrative configuration of a first insulated CPU socket contact coupled to a second insulated CPU socket contact, in accordance with at least one embodiment described herein.

FIG. 3 depicts an illustrative configuration 300 of a first insulated contact 302 coupled to a second insulated contact 304, in accordance with at least one embodiment described herein. The first insulated contact 302 includes a first contact 306 that is at least partially encapsulated by a first insulated enclosure 308, and the second insulated contact 304 includes a second contact 310 that is at least partially encapsulated by a second insulated enclosure 312, in accordance with at least one embodiment described herein. The first insulated enclosure 308 encapsulates the metal CPU socket contact body of the first contact 306, in accordance with at least one embodiment described herein. The second insulated enclosure 312 encapsulates the metal CPU socket contact body of the second contact 310, in accordance with at least one embodiment described herein. The first insulated enclosure 308 and the second insulated enclosure 312 are rectangular cuboids, are cylindrical, or are otherwise polyhedron-shaped, in accordance with at least one embodiment described herein. The first insulated contact 302 is adhered to the second insulated contact 304 by applying adhesive between the first insulated enclosure 308 and the second insulated enclosure 312, in accordance with at least one embodiment described herein. The first insulated contact 302 is physically in contact with the second insulated contact 304 by placing the first insulated enclosure 308 in proximity to the second insulated enclosure 312, in accordance with at least one embodiment described herein. The first insulated enclosure 308 and the second insulated enclosure 312 may represent portions of the socket body 102 (shown in FIG. 1), or the first insulated enclosure 308 and the second insulated enclosure 312 may be slid into openings in the socket body 102, in accordance with at least one embodiment described herein. The insulation and thickness of the first insulated enclosure 308 and of the second insulated enclosure 312 provide a dielectric or spacing between metal portions of the CPU socket contact bodies to at least partially define the capacitive coupling between the first insulated contact 302 and the second insulated contact 304, in accordance with at least one embodiment described herein.

The first insulated contact 302 and the second insulated contact 304 are illustrated with illustrative examples of solder balls 314 and 316, which may physically and electrically couple the first insulated contact 302 and the second insulated contact 304 to a motherboard, in accordance with at least one embodiment described herein.

Figure 4:
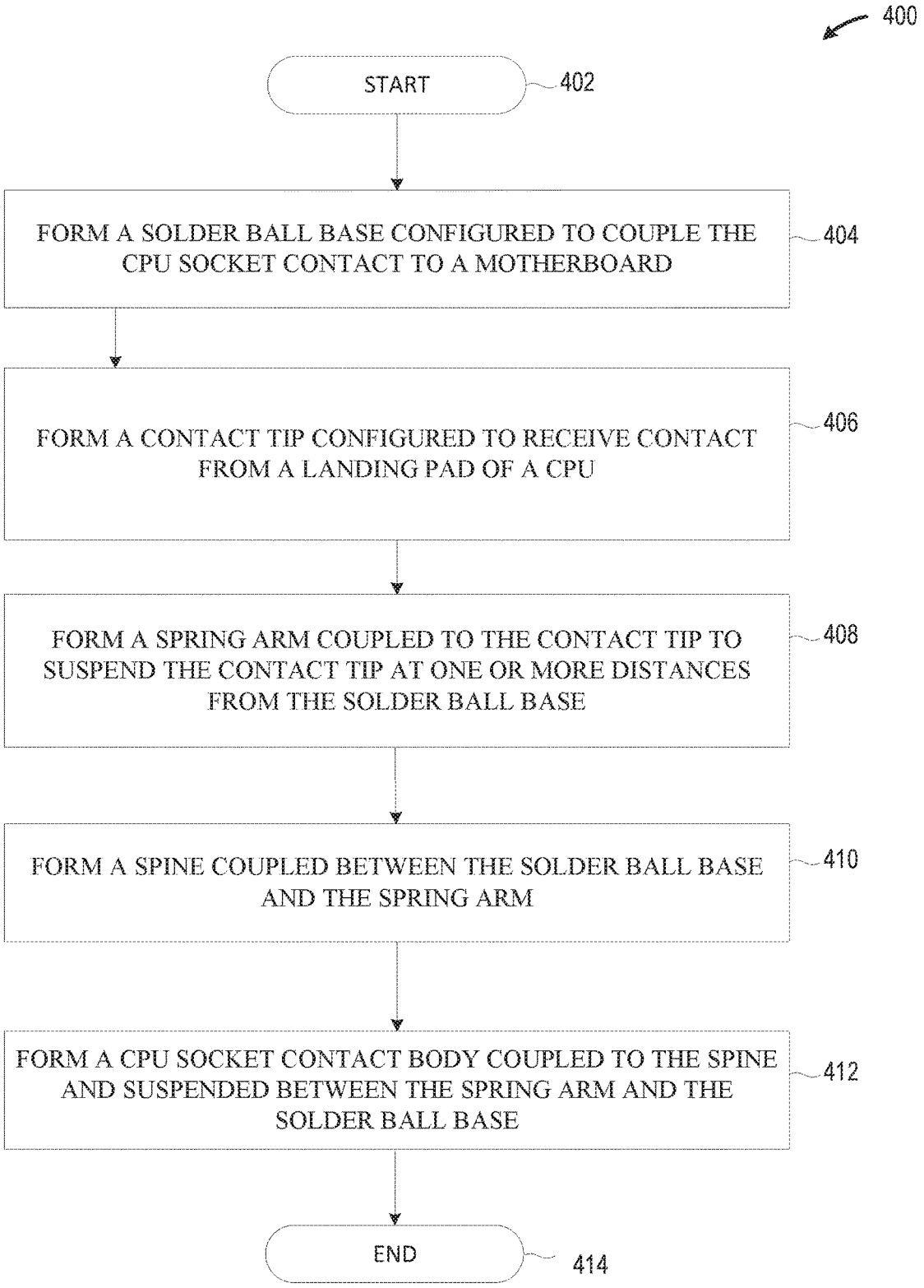
FIG. 4 is a high-level logic flow diagram of an illustrative method of manufacturing a CPU socket contact, in accordance with at least one embodiment described herein.

FIG. 4 is a high-level logic flow diagram of an illustrative method 400 of manufacturing a CPU socket contact, in accordance with at least one embodiment described herein. The described operations of the method 400 may be performed in any order, regardless of the order described below, according to various embodiments. The method 400 commences at 402.

At 404, the method 400 includes forming a solder ball base configured to couple the CPU socket contact to a motherboard, in accordance with at least one embodiment described herein.

At 406, the method 400 includes forming a contact tip configured to receive contact from a landing pad of a CPU, in accordance with at least one embodiment described herein.

At 408, the method 400 includes forming a spring arm coupled to the contact tip to suspend the contact tip at one or more distances from the solder ball base, in accordance with at least one embodiment described herein.

At 410, the method 400 includes forming a spine coupled between the solder ball base and the spring arm, in accordance with at least one embodiment described herein.

At 412, the method 400 includes forming a CPU socket contact body coupled to the spine and suspended between the spring arm and the solder ball base, in accordance with at least one embodiment described herein.

The method 400 concludes at 414.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. The embodiments are not limited to this context.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present invention should not be limited by any of the above-described exemplary embodiments, but should be defined only in accordance with the following claims and their equivalents.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment", "an embodiment", or "an implementation" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The following examples pertain to further embodiments. The following examples of the present disclosure may comprise subject material such as at least one device, a method, at least one machine-readable medium for storing instructions that when executed cause a machine to perform acts based on the method, and/or a system for fabricating a CPU socket contact.

According to example 1, there is provided a central processing unit ("CPU") socket contact. The CPU socket contact may include: a solder ball base configured to couple the CPU socket contact to a motherboard; a contact tip configured to receive contact from a landing pad of a CPU; a spring arm coupled to the contact tip to suspend the contact tip at one or more distances from the solder ball base; a spine coupled between the solder ball base and the spring arm; and a CPU socket contact body coupled to the spine and suspended between the spring arm and the solder ball base. The solder ball base, contact tip, spring arm, spine, and CPU socket contact body may be formed from a single piece of metal.

Example 2 may include the elements of example 1 where a height of the CPU socket contact from the solder ball base to the contact tip is approximately 3 mm.

Example 3 may include the elements of example 1 where a height of the CPU socket contact from the solder ball base to the contact tip is in a range of 1.7 mm to 4 mm.

Example 4 may include the elements of example 1 where the CPU socket contact body includes a cavity that extends through the CPU socket contact body, wherein the cavity extends perpendicularly to the solder ball base.

Example 5 may include the elements of example 1 where the CPU socket contact body is cylindrical or polyhedron-shaped.

Example 6 may include the elements of example 1 where the CPU socket contact body is a rectangular cuboid.

Example 7 may include the elements of example 1 where the CPU socket contact body includes one or more of a first surface, a second surface, and a third surface, wherein the first surface is substantially perpendicular to the second surface, wherein the second surface is substantially perpendicular to the third surface, wherein the first surface, the second surface, and the third surface are perpendicular to a plane of the solder ball base.

Example 8 may include the elements of example 7 where the first surface, the second surface, and the third surface capacitively couple the CPU socket contact to adjacent ones of a plurality of CPU socket contacts in a CPU socket.

Example 9 may include the elements of example 1 where the CPU socket contact body includes at least a first surface, a second surface, and a third surface, wherein the first surface is substantially perpendicular to the second surface, wherein the second surface is substantially perpendicular to the third surface, wherein the first surface, the second surface, and the third surface are perpendicular to a plane of the solder ball base.

Example 10 may include the elements of example 9 where wherein the first surface, the second surface, and the third surface capacitively couple the CPU socket contact to adjacent ones of a plurality of CPU socket contacts in a CPU socket.

Example 11 may include the elements of example 1 where wherein the CPU socket contact body generates a capacitive impedance that negates an inductive impedance of the CPU socket contact.

According to example 12, there is provided a central processing unit ("CPU") socket. The CPU socket may include a socket body, which may include a first side configured to be mated proximate to a motherboard; and a second side configured to carry a CPU. The CPU socket may include a CPU socket contact that is one of a plurality of CPU socket contacts coupled to the socket body and extending between the first side and the second side to electrically couple the CPU to the motherboard. The CPU socket contact may include a solder ball base configured to couple the CPU socket contact to the motherboard; a contact tip configured to receive contact from a landing pad of a CPU; a spring arm coupled to the contact tip to suspend the contact tip at one or more distances from the solder ball base; a spine coupled between the solder ball base and the spring arm; and a CPU socket contact body coupled to the spine and suspended between the spring arm and the solder ball base. The solder ball base, contact tip, spring arm, spine, and CPU socket contact body may be formed from a single piece of metal.

Example 13 may include the elements of example 12 where the CPU socket contact body includes a cavity that extends through the CPU socket contact body, wherein the cavity extends perpendicularly to the solder ball base.

Example 14 may include the elements of example 12 where the CPU socket contact body is a rectangular cuboid.

Example 15 may include the elements of example 12 where the CPU socket contact body includes one or more of a first surface, a second surface, and a third surface, wherein the first surface is substantially perpendicular to the second surface, wherein the second surface is substantially perpendicular to the third surface, wherein the first surface, the second surface, and the third surface are perpendicular to a plane of the solder ball base.

Example 16 may include the elements of example 15 where the first surface, the second surface, and the third surface capacitively couple the CPU socket contact to adjacent ones of the plurality of CPU socket contacts in the CPU socket.

Example 17 may include the elements of example 12 where the CPU socket contact body includes at least a first surface, a second surface, and a third surface, wherein the first surface is substantially perpendicular to the second surface, wherein the second surface is substantially perpendicular to the third surface, wherein the first surface, the second surface, and the third surface are perpendicular to a plane of the solder ball base.

Example 18 may include the elements of example 17 where the first surface, the second surface, and the third surface capacitively couple the CPU socket contact to adjacent ones of the plurality of CPU socket contacts in the CPU socket.

Example 19 may include the elements of example 12 where the CPU socket contact body generates a capacitive impedance that substantially cancels an inductive impedance of the CPU socket contact.

Example 20 may include the elements of example 12, and the CPU socket may further include a plurality of insulated enclosures, wherein each of the plurality of insulated enclosures at least partially encapsulate one of each of the plurality of CPU socket contacts.

According to example 21, there is provided a central processing unit ("CPU") socket. The CPU socket may include a socket body, which may include a first side configured to be mated proximate to a motherboard; and a second side configured to carry a CPU. The CPU socket may include a CPU socket contact that is one of a plurality of CPU socket contacts coupled to the socket body and extending between the first side and the second side to electrically couple the CPU to the motherboard. The CPU socket contact may include a solder ball base configured to couple the CPU socket contact to the motherboard; a contact tip configured to receive contact from a landing pad of a CPU; a spring arm coupled to the contact tip to suspend the contact tip at one or more distances from the solder ball base; a spine coupled between the solder ball base and the spring arm; and means for inducing capacitive impedance to substantially cancel an inductive impedance of the CPU socket contact.

Example 22 may include the elements of example 21 where the solder ball base, contact tip, the spring arm, the spine, and the means for inducing capacitive impedance to substantially cancel an inductive impedance of the CPU socket contact are formed from a single piece of metal.

Example 23 may include the elements of example 21, and the CPU socket may further include an insulated enclosure, wherein the insulated enclosure at least partially encapsulates the CPU socket contact.

Example 24 may include the elements of example 21 where the insulated enclosure is cylindrical or polyhedron-shaped.

Example 25 may include the elements of example 21 where the insulated enclosure is rectangular cuboid.

According to example 26, there is provided a method of manufacturing a central processing unit ("CPU") socket contact. The method includes forming a solder ball base configured to couple the CPU socket contact to a motherboard; forming a contact tip configured to receive contact from a landing pad of a CPU; forming a spring arm coupled to the contact tip to suspend the contact tip at one or more distances from the solder ball base; forming a spine coupled between the solder ball base and the spring arm; and forming a CPU socket contact body coupled to the spine and suspended between the spring arm and the solder ball base. The solder ball base, contact tip, the spring arm, the spine, and the CPU socket contact body may be formed from a single piece of metal.

Example 27 may include the elements of example 26 where a height of the CPU socket contact from the solder ball base to the contact tip is 3 mm.

Example 28 may include the elements of example 26 where a height of the CPU socket contact from the solder ball base to the contact tip is in a range of 1.7 mm to 4 mm.

Example 29 may include the elements of example 26 where forming the CPU socket contact body includes forming the CPU socket contact body with a cavity that extends through the CPU socket contact body, wherein the cavity extends perpendicularly to the solder ball base.

Example 30 may include the elements of example 26 where the CPU socket contact body is a rectangular cuboid.

Example 31 may include the elements of example 26 where the CPU socket contact body generates a capacitive impedance that effectively cancels an inductive impedance of the CPU socket contact.

According to example 32, a motherboard may have a CPU socket that includes an array of CPU socket contacts, wherein the array of CPU socket contacts includes at least one CPU socket contact of any of examples 1 through 11.

According to example 33, a motherboard may have the CPU socket of any of examples 12 through 25.

According to example 34, at least one machine readable medium may include a plurality of instructions that, in response to be being executed on a computing device, cause the computing device to carry out the method according to any of examples 26 through 31.

According to example 35, an electronic device is provided that may have a CPU socket of any of examples 12 through 25.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. A central processing unit ("CPU") socket contact, comprising:

a solder ball base that extends along a horizontal plane and that is configured to couple the CPU socket contact to a motherboard;

a spring arm to suspend a CPU landing pad contact tip at one or more distances from the solder ball base;

a spine coupled between the solder ball base and the spring arm; and a CPU socket contact body that is coupled to the spine and that includes a cavity comprising a plurality of cavity surfaces that are each perpendicular to the horizontal plane;

wherein:

the CPU socket contact body generates a capacitive impedance that at least substantially negates an inductive impedance of the CPU socket contact; and the plurality of cavity surfaces capacitively couple the CPU socket contact to adjacent CPU socket contacts of a plurality of CPU socket contacts in a CPU socket.

2. The CPU socket contact of claim 1 wherein a height of the CPU socket contact from the solder ball base to the CPU landing pad contact tip is approximately 3 mm.

3. The CPU socket contact of claim 1 wherein a height of the CPU socket contact from the solder ball base to the CPU landing pad contact tip is in a range of 1.7 mm to 4 mm.

4. The CPU socket contact of claim 1 wherein:

the solder ball base and the CPU landing pad contact tip are external to the cavity;

and the cavity extends through the CPU socket contact body and substantially perpendicular to the horizontal plane.

5. The CPU socket contact of claim 1 wherein the CPU socket contact body is cylindrical or polyhedron-shaped.

6. The CPU socket contact of claim 1 wherein the CPU socket contact body is a rectangular cuboid.

7. The CPU socket contact of claim 1 wherein the plurality of cavity surfaces include a first surface, a second surface, and a third surface, and wherein:

the first surface is substantially perpendicular to the second surface; and the second surface is substantially perpendicular to the third surface.

8. The CPU socket contact of claim 1 wherein the CPU socket contact is formed from a single piece of metal.

9. The CPU socket contact of claim 1 wherein the portion of the CPU landing pad contact tip that is laterally offset from the cavity is laterally offset from the open end of said cavity and from said solder ball base.

10. A central processing unit ("CPU") socket, comprising:

a socket body, including:

a first side configured to be mated proximate to a motherboard; and a second side configured to carry a CPU; and a CPU socket contact that is one of a plurality of CPU socket contacts coupled to the socket body and extending between the first side and the second side to electrically couple the CPU to the motherboard, wherein the CPU socket contact includes:

a solder ball base that extends along a horizontal plane and that is configured to couple the CPU socket contact to the motherboard;

a spring arm to suspend a CPU landing pad contact tip at one or more distances from the solder ball base;

a spine coupled between the solder ball base and the spring arm; and a CPU socket contact body that is coupled to the spine and that includes a cavity comprising a plurality of cavity surfaces that are each perpendicular to the horizontal plane;

wherein:

the CPU socket contact body generates a capacitive impedance that at least substantially negates an inductive impedance of the CPU socket contact; and the plurality of cavity surfaces capacitively couple the CPU socket contact to adjacent CPU socket contacts of the plurality of CPU socket contacts.

11. The CPU socket of claim 10 wherein:

the solder ball base and CPU landing pad contact tip are external to the cavity;

and the cavity extends through the CPU contact body and substantially perpendicular to the horizontal plane.

12. The CPU socket of claim 10 wherein the CPU socket contact body is a rectangular cuboid.

13. The CPU socket of claim 10 wherein the plurality of cavity surfaces include a first surface, a second surface, and a third surface, and wherein:

the first surface is substantially perpendicular to the second surface; and the second surface is substantially perpendicular to the third surface.

14. The CPU socket of claim 10 wherein the CPU socket contact is formed from a single piece of metal.

15. The CPU socket of claim 10 wherein the portion of the CPU landing pad contact tip that is laterally offset is laterally offset from said open end of said cavity and from said solder ball base.

16. The CPU socket of claim 10, further comprising:

a plurality of insulated enclosures, wherein each of the plurality of insulated enclosures at least partially encapsulate one of each of the plurality of CPU socket contacts.

17. A central processing unit ("CPU") socket, comprising:

a socket body, including:

a first side configured to be mated proximate to a motherboard; and a second side configured to carry a CPU; and a CPU socket contact that is one of a plurality of CPU socket contacts coupled to the socket body and extending between the first side and the second side to electrically couple the CPU to the motherboard, wherein the CPU socket contact includes:

a solder ball base that extends along a horizontal plane and that is configured to couple the CPU socket contact to the motherboard;

a spring arm to suspend a CPU landing pad contact tip at one or more distances from the solder ball base;

a spine coupled between the solder ball base and the spring arm; and a CPU socket contact body that is coupled to the spine and that includes a cavity comprising a plurality of cavity surfaces that are each perpendicular to the horizontal plane, wherein:

the CPU socket contact body induces a capacitive impedance that at least substantially negates an inductive impedance of the CPU socket contact; and the plurality of cavity surfaces capacitively couple the CPU socket contact to adjacent CPU socket contacts of the plurality of CPU socket contacts.

18. The CPU socket of claim 17 wherein the CPU socket contact is formed from a single piece of metal.

19. The CPU socket of claim 17, further comprising:

an insulated enclosure, wherein the insulated enclosure at least partially encapsulates the CPU socket contact.

20. A method of manufacturing a central processing unit ("CPU") socket contact, the method comprising:

forming a solder ball base that extends along a horizontal plane and that is configured to couple the CPU socket contact to a motherboard;

forming a contact tip configured to receive contact from a landing pad of a CPU;

forming a spring arm to suspend the contact tip at one or more distances from the solder ball base;

forming a spine coupled between the solder ball base and the spring arm; and forming a CPU socket contact body that is coupled to the spine and that includes a cavity comprising a plurality of cavity surfaces that are each perpendicular to the horizontal plane, wherein:

the CPU socket contact body generates a capacitive impedance that at least substantially negates an inductive impedance of the CPU socket contact body; and the plurality of cavity surfaces capacitively couple the CPU socket contact to adjacent CPU socket contacts of a plurality of CPU socket contacts in a CPU socket.

21. The method of claim 20 wherein a height of the CPU socket contact from the solder ball base to the contact tip is 3 mm.

22. The method of claim 20 wherein a height of the CPU socket contact from the solder ball base to the contact tip is in a range of 1.7 mm to 4 mm.

23. The method of claim 20 wherein:

the solder ball base and contact tip are external to the cavity;

and the cavity extends through the CPU socket contact body and substantially perpendicular to the horizontal plane.

24. The method of claim 20 wherein the CPU socket contact body is a rectangular cuboid.

25. The method of claim 20 wherein the portion of the contact tip that is laterally offset is laterally offset from the open end of said cavity and from said solder ball base.

* * * * *